United States Patent [19]

Freimann et al.

[11] Patent Number: 4,960,439

[45] Date of Patent: Oct. 2, 1990

[54] ARRANGEMENT FOR GASIFYING FUELS

[75] Inventors: Paul Freimann, St. Valentin; Gernot Staudinger, Graz, both of Austria

[73] Assignee: Voest-Alpine Aktiengesellschaft, Linz, Austria

[21] Appl. No.: 291,402

[22] Filed: Aug. 12, 1988

Related U.S. Application Data

[63] Continuation of Ser. No. 832,988, Feb. 25, 1986, abandoned.

[30] Foreign Application Priority Data

Mar. 8, 1985 [AT] Austria ..... 695/85

[51] Int. Cl.[5] ..... C10J 3/20

[52] U.S. Cl. ..... 48/62 R; 48/63; 48/67; 48/69; 48/77; 48/111

[58] Field of Search ..... 48/62 R, 63, 73, 76, 48/77, 67, 69, DIG. 2, 64, 111; 110/165 R

[56] References Cited

U.S. PATENT DOCUMENTS 815,794 3/1906 Cerasoli ..... 48/73
4,323,066 4/1982 Staudinger ..... 48/73

FOREIGN PATENT DOCUMENTS 1200102 2/1986 Canada .
0072457 2/1983 European Pat. Off. .
57-70187A 4/1982 Japan .

*Primary Examiner*—Peter Kratz
*Attorney, Agent, or Firm*—Ostrolenk, Faber, Gerb & Soffen

[57] ABSTRACT

An arrangement for the gasification of fuels with oxygen or oxygen-containing gases and steam, includes a shaft-like vessel for receiving solid charging stock. A gas discharge duct is provided on the upper end of the vessel and a primary gas chamber is in connection with the shaft-like vessel on its lower end via a passage. In the primary gas chamber a burner is provided, which includes feedings for oxygen or oxygen-containing gases as well as for fuels. A trough for receiving slag is arranged below. the primary gas chamber and a supporting bottoms is provided between the trough and the shaft-like vessel, reaching into the primary gas chamber, for the formation of a dumping material bed of the solid charging stock facing the burner by one dumping surface. In order to be able to gasify low-quality fuels into a high-quality product gas, the primary gas chamber includes a charging opening for charging a charging stock to be gasified. The supporting floor, on the side of the burner, is extended to such an exent that a second dumping stock bed of the charging stock to be gasified forms, lying in front of the first dumping surface and facing the burner with a second, free, dumping surface.

3 Claims, 2 Drawing Sheets

ARRANGEMENT FOR GASIFYING FUELS

This application is a continuation of application Ser. No. 832,988, filed Feb. 25, 1986, now abandoned.

BACKGROUND OF THE INVENTION

1. Field of the Invention

The invention relates to an arrangement for the gasification of fuels with oxygen or oxygen-containing gases and steam. The arrangement comprises a shaft-like vessel for receiving solid charging stock, a gas discharge duct on the upper end of the vessel and a primary gas chamber in connection with the shaft-like vessel on its lower end via a passage, in which chamber a burner is provided including feedings for oxygen or oxygen-containing gases as well as for fuels and, if desired, steam, a trough for receiving slag, and a supporting bottom provided between the trough and the shaft-like vessel and reaching into the primary gas chamber for the formation of a dumping material bed of the solid charging stock facing the burner by one dumping surface.

2. Description of the Related Art

An arrangement of this type is known from German Auslegeschrift No. 2,920,922. By this arrangement, it is possible to use as charging stock, and to gasify, fuels that contain free carbon, such as anthrazite, bituminous coals, brown coal, briquets, etc. The fuel form a dumping cone in the primary gas chamber, and has a free surface that takes its root from a slag bath.

During the gasification of low-quality fuels, undesired emissions contained in the drawn-off product gas may emerge. Thus, it is disadvantageous to gasify highly volatile hard coal with a high tar content, because tar will be contained in the product gas. If wet brown coal is gasified, the product gas will contain a high portion of steam.

SUMMARY OF THE INVENTION

The invention has as its object to provide an advanced arrangement of the initially described type to make feasible the gasification of not only high-quality fuel, such as coke, but even of low-quality fuel, such as wet brown coal or hard coal with a high tar content, for example, used tires, etc. The product gas is free of detrimental impurities, which, in particular, reduce the calorific value, restrict further utilization and constitute a load on the environment.

This object is achieved according to the invention in that the primary gas chamber is provided, adjacent to the passage referred to above, with an opening for top-charging charging stock to be gasified, the supporting bottom being so far extended toward the burner that a second dumping stock bed of the charging stock to be gasified forms, such second dumping stock lying in front of the first dumping surface and facing the burner with a second, free surface.

The additional charging stock forms the free dumping surface directly exposed to the burning jet of the burner. Because the dumping stock bed formed by the charging stock is being passed by the primary gas, it is gasified, and a crude gas is formed. The gas is filtered because it is forced to pass the solid charging stock lying, with the first dumping surface, behind the charging stock that is gasified. Tar possibly present in the gas coming from the primary gasification chamber immediately after its generation is cracked while still being in the hot zone of the shaft-like vessel. Thus, a tar-free product gas may be drawn off the vessel.

An embodiment that allows for a compact and thermally favorable mode of construction is characterized in that the shaft-like vessel is divided into two compartments. These compartments are arranged in the direction towards the burner, and divided by a partition wall projecting from consecutively the top of the vessel down into the vessel. The compartment facing away from the burner includes the gas discharge duct and accommodates the first dumping stock bed, in particular a coke bed. The burner-side compartment accommodates the second dumping stock bed of the charging stock to be gasified, in particular a used substance or waste fuel. A dumping cone of the second dumping stock bed departs from the lower edge of the partition wall.

Alternatively, a supply duct for the charging stock to be gasified, which is delimited by a segment-shaped slide surface on the side of the wall enters into the burner-side wall of the vessel. A partition wall for the formation of two compartments of the vessel departs from the burner-side wall, downwardly extending in a slanted manner, preferably under an angle of inclination of between 30° and 45° .

Suitably, the partition wall is provided with an internal cooling and at least in the lower part is lined with refractory material.

A fuel-saving method for operating the arrangement according to the invention is achieved by adjusting the burner to a stoichiometric ratio of C to O in the range of from 1.0 to 2.0. The combustion space temperature is in the range of from 1,500° to 1,800° C.

DETAILED DESCRIPTION OF THE PREFERRED EMBODIMENTS

The invention will now be described in more detail by way of two embodiments and an application example, with reference to the accompanying drawings.

Figure 1:
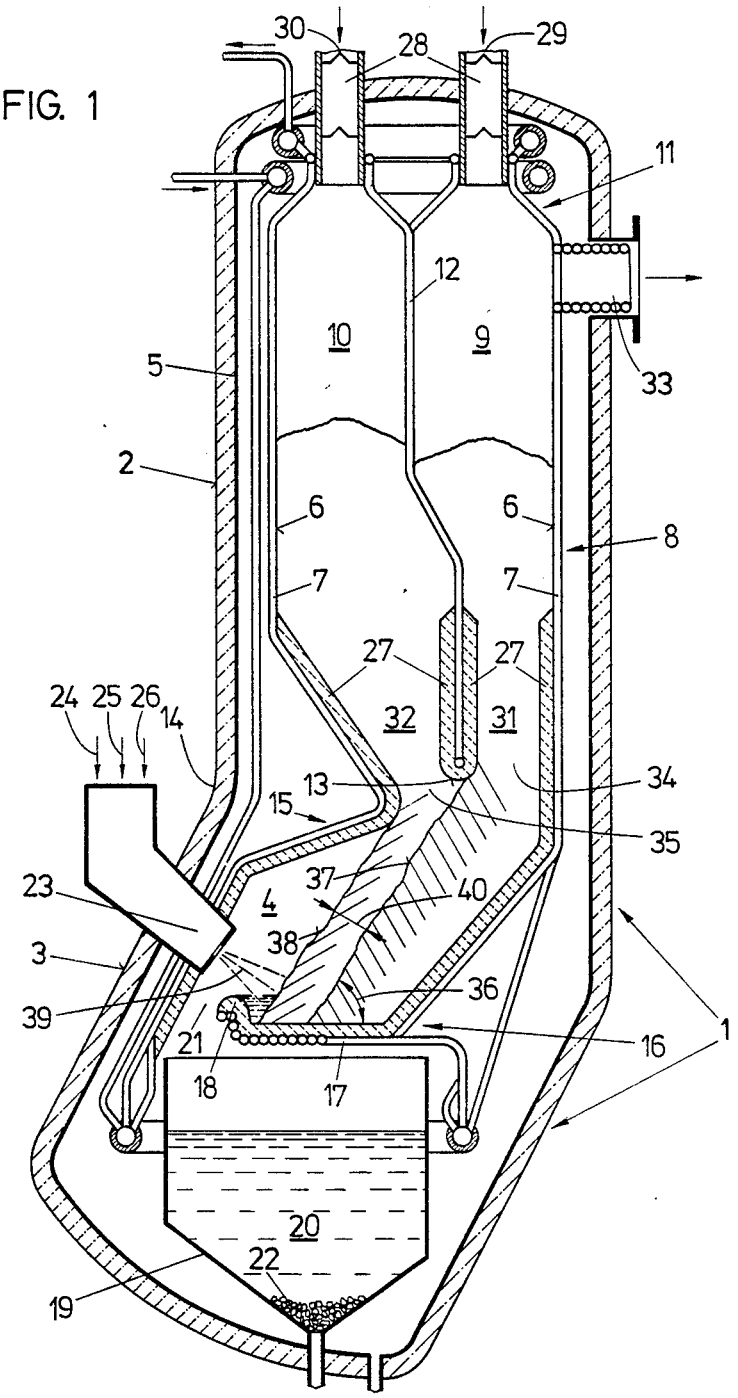
FIGS. 1 and 2 each illustrate an embodiment of a shaft gasifier in the vertical section.

Referring to FIG. 1, a shaft gasifier 1 is comprised of a vertical upper section 2, preferably of a circular cross section, and a laterally angled lower section 3 that constitutes the primary gas chamber 4. Since the shaft gasifier 1 may be operated without pressure and under pressure, its outer shell 5 is designed accordingly, i.e., as a pressure vessel or as a common gas-tight vessel.

Within the outer shell 5, a vessel 8 is provided, which comprises cooled walls 6, in particular walls 6 that are composed of pipes 7 through which coolant flows, and is designed as a basket. The part of the basket that lies within the vertical section 2 of the shaft gasifier 1, that forms the two compartments 9, 10, comprises a partition wall 12 provided with internal cooling means extending downwardly from the upper end 11 of the basket 8. The partition walls lower free edge 13 lies approximately at the height of the connection 14 of the angled lower section 3 of the shaft gasifier with its vertical part 2. At this height, the basket, furthermore, comprises an inwardly extending projection 15 terminating in a second free edge, which forms the upper limitation of the primary gas chamber 4 arranged therebelow.

The lower end 16 of the basket 8 is formed by an approximately horizontally directed supporting bottom 17. The supporting bottom also comprises an internal cooling and the free end projecting into the primary gas chamber is designed as a slag overflow weir 18. Below the supporting bottom 17, there is provided a trough 19, which is filled with coolant 20 for the granulation of the slag 22 passing the overflow weir and leaving the primary gas chamber 4 via a passage opening 21.

Above the slag overflow weir 18, a burner 23 enters into the primary gas chamber 4, which receives feed lines 24, 25, 26 for fuels, oxygen (or air) and, if desired, steam.

The basket 8, as far as to the level of the first third of its vertical portion on its internal side—its partition wall 12 on both sides—is coated with refractory material 27. The two compartments 9, 10 of the basket 8, on their upper ends, comprise charging openings 29, 30 for the charging stock 31, 32, which are each closeable by a sluice 28. The compartment 9 that is remote from the burner 23, near the upper end 11, is provided with a gas discharge duct 33 for the product gas forming and enters into the primary gas chamber 4 via a passage 34. The compartment 10, that is located closer to the burner 23 than compartment 9, enters into the primary gas chamber 4 via a charging opening 35 neighboring the passage 34.

The arrangement functions in the following manner:

At first, charging stock 31, in particular coke, is introduced into the compartment 9 remote from the burner 23, whereby, according to the dumping angle 36 of the coke, a dumping stock bed having a first dumping surface 37 facing the burner 23 forms. This dumping surface 37 departs from the lower edge 13 of the partition wall 12.

Subsequently, the charging stock 32 to be gasified is charged into the compartment 10 of the basket 8 close to the burner 23. Charging stock 32 forms a further dumping stock bed covering the first dumping stock bed and having a free dumping surface 38 facing the burner, to which the burner jet 39 is directed.

The charging stock 32 to be gasified, which is introduced into the compartment 10 close to the burner 23, may be of low quality, such as for instance, brown coal, highly volatile hard coal or used tires. This charging stock is gasified after ignition of the burner 23. The steam contained in the charging stock participating in the gasification reactions, higher hydrocarbons from the pyrolysis being cracked, and crude gas forming due to the position of the gas discharge duct 33 in the compartment 9 remote from the burner, are forced to pass the dumping stock bed of, for instance, coke 31 lying therebehind. When passing the coke, the crude gas is filtered so that the crude gas leaving the compartment 9 has a high purity: it is free primarily of higher hydrocarbons.

Depending on the thickness 40 of the dumping stock bed of the charging stock 32 to be gasified and on the adjustment of the primary gasification, the charging stock, e.g., coke, lying behind the second charging stock bed may also be gasified or merely serves as a filter for the passing crude gas in the first place. The adjustment of the primary gasification is effected by the ratio oxygen/carbon carriers in the burner, or the overall amount of primary gasification substances, or—in the case of pure oxygen instead of air being introduced via the burner—by the ratio oxygen/steam. Depending on the position of the lower edge 13 of the partition wall 12, the thickness 40 of the second dumping stock bed of the charging stock 32 to be gasified and, thus, the gasification of the charging stock 31 located therebehind, are controlled.

Figure 2:
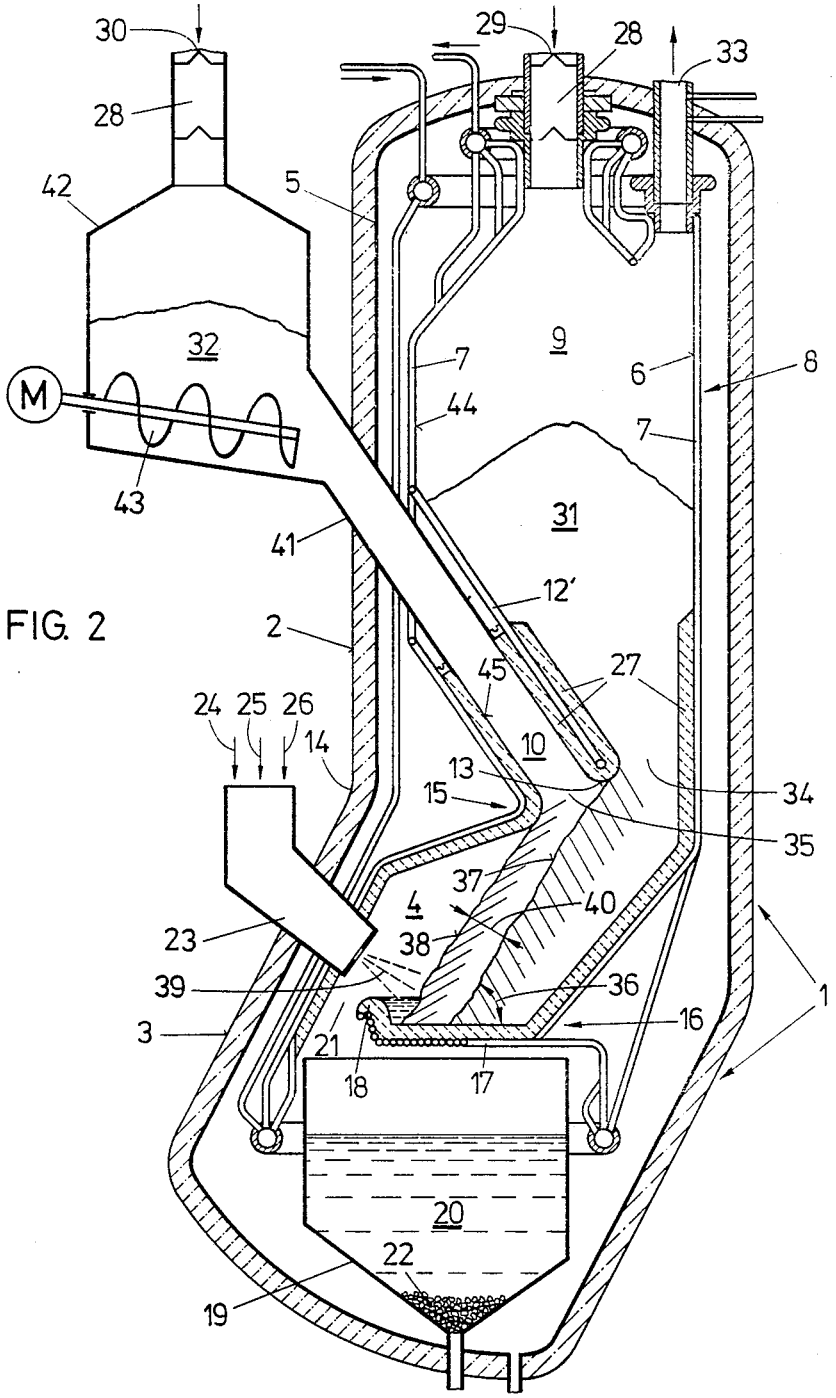

According to the embodiment illustrated in FIG. 2, a supply duct 41 for the charging stock 32 to be gasified enters into the vertical part 2 of the shaft gasifier 1. The charging stock flows from a container 42 connected to the supply duct 41 into the primary gas chamber 4 to form a dumping stock bed by a conveying means, such as a worm conveyor 43. According to the embodiment illustrated in FIG. 2, the partition wall 12' for the formation of the two dumping stock beds is directed obliquely downwards, preferably at an angle of 30° to 45°, towards the primary gas chamber 4, departing from the burner-side wall 44 of the basket 8. Like partition wall 12, partition wall 12' is provided with internal cooling means and its lower portion lined with refractory material 27.

The charging stock 32 to be gasified, through the supply duct 41, slides over a slide surface 45, which is cooled and provided with a refractory lining, as far as to the charging opening entering into the primary gas chamber 4.

It will be apparent from the above description of the apparatus of this invention and the drawing figures referred to that due to the partition wall 12 (FIG. 1) and the partition wall 12' and the walls of the supply duct 41 (FIG. 2), all the product gas is withdrawn directly from the gasifier after passing through the coke bed.

In the following, the gasification of low-quality fuel will be explained by way of an example:

Fuel comprising used oil as well as a pasty residue from a paper factory (i.e., a hydrolysis residue from an enzymatic hydrolysis and air at a pressure of 4 bar are fed to the burner 23 and are burnt there. In Table I, the analysis of the used oil, and in Table II the analysis of the pasty residue, are indicated.

TABLE I

| Used oil analysis | | |
|---|---|---|
| C | H | O |
| 86.10% by weight | 12.00% by weight | 0.16% by weight |
| N | S | |
| 0.24% by weight | 1.50% by weight | |

TABLE II

| Pasty residue analysis | | |
|---|---|---|
| C | H | O |
| 43.3% by weight | 6.1% by weight | 50.6% by weight |
| N | S | |
| — | — | |

To the burner 23, also sewage sludge, paper machee or even dusty combustion materials may be supplied in pasty form.

Per hour, used oil in an amount of 3,800 kg, pasty residue in an amount of 1,258 kg and air preheated to 500° C. in an amount of 32,000 $Nm^3$ were supplied.

The primary gas forming by combustion in the burner accrued in an amount of 38,181 $Nm^3/h$ (wet) at a temperature of 1,510° C. When contacting the charging stock 32 to be gasified in the second dumping stock bed, the primary gas reacts with the charging stock 32 to be gasified, and converts into crude gas. The charging stock may also be comprised of used tires (analysis Table III) and of deinking sludge—a residue from used paper processing including printing ink and fillers—(chemical analysis Table IV).

TABLE III

| Used tires analysis | | | |
|---|---|---|---|
| Water: | 0.10% | C | 87.77% by weight |
| Ashes: | 23.50% | H | 9.33% by weight |
| Liquid | | 0 | 0.55% by weight |
| components: | 51.28% | N | 0.38% by weight |
| C fixed: | 25.12% | S | 1.97% by weight |

TABLE IV

| Deinking sludge analysis | | | |
|---|---|---|---|
| Water: | 50.00% | C | 53.95% by weight |
| Ashes: | 27.48% | H | 7.55% by weight |
| Liquid | | 0 | 38.08% by weight |
| components: | 21.09% | N | — |
| C fixed: | 1.43% | S | 0.42% by weight |

Used tires were employed in an amount of 1,300 kg/h and deinking sludge was employed in an amount of 2,560 kg/h. The crude gas entered the second dumping stock bed at approximately 864° C. The crude gas subsequently streamed through the dumping stock bed of coke and was drawn off as ready product gas in an amount of 46,924 $Nm^3/h$. Its analysis is reflected in Table V.

TABLE V

| Product gas analysis | |
|---|---|
| $CO_2$ | 5.96% |
| $H_2O$ | 6.67% |
| $H_2$ | 16.16% |
| CO | 17.32% |
| $N_2$ | 53.90% |
| $CH_4$ | 0.03% |
| COS | 0.01% |
| $H_2S$ | 0.15% |

The thermic efficacy of the process, which is defined as the ratio of product gas amount multiplied by product gas calorific value plus sensible heat of product gas to the sum of the amount of charging substances multiplied by their respective calorific value, amounted to 91 %. The gasification efficacy, which is defined as the ratio of product gas amount multiplied by product gas calorific value to the sum of the amount of charging substances multiplied by their respective, calorific value, amounted to 73 %.

The calorific value of the product gas was 949 $kcal/Nm^3$. In the slag container 19, vitrified slag in granular form accrued in an amount of 1,408 kg/h.

According to a further example, the arrangement was operated at a pressure of 4 bar. Used oil in an amount of 1,800 kg/h and air, preferably preheated to a temperature of between 100° and 500° C., in an amount of 27,906 $Nm^3/h$ were fed to the burner. As the charging stock, fuel of waste was employed in an amount of 13,147 kg/h. The consumption of coke as charging material was 399 kg/h. The crude gas forming accrued in an amount of 45,500 $Nm^3/h$.

The operation of the burner was effected at a ratio of C to 0= lambda in the range of 1.5, the temperature in the primary gas chamber being 1,656° C. and the temperature of the crude gas being 849° C. In the following Tables VI to IX the analysis values for the used oil, the fuel of waste, the product gas and the coke are indicated.

TABLE VI

| Used oil analysis | | | |
|---|---|---|---|
| $H_2O$ | 5.00% by weight | O | 0.15% by weight |
| Ashes | 0.50% by weight | N | 0.23% by weight |
| C | 82.08% by weight | S | 0.61% by weight |
| H | 11.43% by weight | | |

TABLE VII

| Fuel of waste analysis | | | |
|---|---|---|---|
| $H_2O$ | 30.00% by weight | O | 17.65% by weight |
| Ashes | 16.09% by weight | N | 0.61% by weight |
| C | 30.78% by weight | S | 0.50% by weight |
| H | 4.37% by weight | | |

TABLE VIII

| Product gas analysis | | | |
|---|---|---|---|
| CO | 13.70 | $H_2O$ | 12.52 |
| $CO_2$ | 8.89 | $N_2$ + Ar | 48.62 |
| $CH_4$ | 1.41 | $H_2S$ | 0.11 |
| $H_2$ | 14.74 | COS | 0.01 |

TABLE IX

| Coke analysis | | | |
|---|---|---|---|
| $H_2O$ | 6.60% by weight | O | 0.16% by weight |
| Ashes | 8.50% by weight | N | 0.91% by weight |
| C | 82.79% by weight | S | 0.76% by weight |
| H | 0.28% by weight | | |

What we claim is:

1. In an arrangement for gasifying fuels with oxygen or oxygen-containing gases and steam including a vessel that accommodates solid charging stock, said vessel having an upper section, a lower section and side walls and including a gas discharge duct on said upper section, a primary gas chamber within said lower section, means defining a first charging passage between said primary gas chamber and said upper section providing passage of said solid charging stock into said primary gas chamber, burner means penetrating through a side wall of said vessel into said primary gas chamber and including feed means for at least one of oxygen and oxygen-containing gases as well as for fuel and steam, a trough in said vessel arranged below said primary gas chamber to accommodate slag, and a support bottom above said trough, said support bottom defining the lower end of said primary gas chamber so that when said solid charging stock is charged into said vessel a first bed of said solid charging stock having a first sloping surface facing said burner means is formed, the improvement comprising providing:

a charging stock supply duct for supplying charging stock to be gasified entering into said vessel in its burner-side wall, said supply duct including walls and a slide surface; a partition wall extending obliquely downward from said burner-side wall so as to divide said vessel upper section into a first compartment and a second compartment, said first compartment including said gas discharge duct in its upper portion and being provided with a charging stock supply duct at its upper end, said first charging passage being between said primary gas chamber and said first compartment; said second compartment containing the burner-side wall supply duct; and means defining a second charging passage between said primary gas chamber and said burner-side wall supply duct, said second passage providing passage of said charging stock to be gasified therethrough to form a second bed of said charging stock to be gasified having a free second sloping surface facing said burner means, said second bed lying in front of said first bed.

2. An arrangement as set forth in claim 1, wherein said partition wall is inclined by 30° to 45° .

3. An apparatus for gasifying low quality solid fuel and coke with oxygen or oxygen containing gases and steam, in which all the gas produced therein is withdrawn through said apparatus, comprising:

a vessel having a vertical upper section, said vessel having side walls, an upper end and a lower end; and a lower section attached to the lower end of said vertical upper section, coke charging means and gas discharge means on the upper end of said vertical upper section, a primary gas chamber within said lower section, burner means penetrating through a side wall of said vessel into said primary gas chamber, said burner means including feed means for feeding fuel and at least one of oxygen, oxygen-containing gases and steam, a substantially horizontally extending supporting bottom projecting into said primary gas chamber to support said low quality solid fuel and said coke, slag tapping means within said vessel below said supporting bottom, means defining a coke passage between said vertical upper section and said primary gas chamber, said means including a first free edge disposed between the side walls of said vertical upper section, means defining a low quality fuel passage adjacent said coke passage, said means including a second free edge disposed between said first free edge and said burner means, which vessel, in operation, accommodates a coke bed having an upper free surface facing toward said coke charging opening in said vertical upper section, a coke column extending substantially vertically from said upper free surface to said first free edge, and a sloping coke bed extending from said first free edge to said supporting bottom; and a sloping bed of low quality solid fuel extending from said second free edge to said supporting bottom, said low quality solid fuel bed being superposed on said coke bed and having a free surface facing said burner means, so that said low quality solid fuel is gasified to form crude gas, which crude gas is forced through and filtered by said coke bed to leave said gas discharge means as a gas of high purity, said apparatus being provided with a charging stock supply duct for supplying said low quality fuel entering into said vessel in its burner-side wall, said supply duct including walls and a slide surface; a partition wall extending obliquely downward from said burner-side wall, said partition wall terminating in said first free edge; said low quality fuel passage being between said primary gas chamber and said supply duct.

* * * * *